US010370828B2

(12) United States Patent
Ruvang

(10) Patent No.: US 10,370,828 B2
(45) Date of Patent: Aug. 6, 2019

(54) SECUREMENT OF A WEAR MEMBER TO AN EXCAVATION IMPLEMENT

(71) Applicant: BLACK CAT BLADES LTD., Edmonton (CA)

(72) Inventor: John A. Ruvang, Bartonville, TX (US)

(73) Assignee: BLACK CAT WEAR PARTS LTD., Edmonton (CA)

( * ) Notice: Subject to any disclaimer, the term of this patent is extended or adjusted under 35 U.S.C. 154(b) by 4 days.

(21) Appl. No.: 15/583,503

(22) Filed: May 1, 2017

(65) Prior Publication Data

US 2017/0342688 A1 Nov. 30, 2017

(30) Foreign Application Priority Data

May 26, 2016 (WO) ..... PCT/US16/34332

(51) Int. Cl.
*E02F 9/28* (2006.01)
*E02F 3/40* (2006.01)

(52) U.S. Cl.
CPC ..... *E02F 9/2883* (2013.01); *E02F 9/2825* (2013.01); *E02F 9/2841* (2013.01); *E02F 3/401* (2013.01); *E02F 9/2808* (2013.01)

(58) Field of Classification Search
CPC ..... E02F 9/2833; E02F 9/2841; E02F 9/2858
See application file for complete search history.

(56) References Cited

U.S. PATENT DOCUMENTS 5,708,431 A 1/1998 Howard
5,765,301 A 6/1998 Clendenning
5,937,550 A 8/1999 Mrich
6,799,386 B2 * 10/2004 Robinson ..... E02F 9/2833 37/452
7,121,023 B2 10/2006 Robinson et al.
7,980,011 B2 * 7/2011 Ruvang ..... E02F 9/2825 37/452
8,127,476 B2 * 3/2012 Bierwith ..... F16B 33/02 172/772

(Continued)

OTHER PUBLICATIONS

International Search Report with Written Opinion dated Feb. 10, 2017 for PCT Patent Application No. PCT/US16/034332, 17 pages.

(Continued)

*Primary Examiner* — Matthew Troutman
(74) *Attorney, Agent, or Firm* — Smith IP Services, P.C.

(57) ABSTRACT

A wear member attachment system for use with an excavation implement can include a connector that releasably secures a wear member to the excavation implement, the connector including an elongated housing and engagement members extendable and retractable relative to the housing. One engagement member can extend relative to the housing when another engagement member retracts relative to the housing, and vice versa. A method of releasably securing a wear member to an excavation implement can include rotating a engagement member of a connector from an extended position in which opposing slots in the engagement member are aligned with respective projections in the wear member, to a retracted position in which the slots are not aligned with the projections. The rotating step can include extending another engagement member of the connector as the first connector displaces from the extended position to the retracted position.

20 Claims, 11 Drawing Sheets

(56) References Cited

U.S. PATENT DOCUMENTS

| | | | | |
|---|---|---|---|---|
| 8,261,472 | B2 * | 9/2012 | Ruvang | E02F 9/2825 37/455 |
| 8,307,574 | B2 * | 11/2012 | Ruvang | E02F 9/2825 37/455 |
| 8,429,838 | B2 * | 4/2013 | Ruvang | E02F 9/2825 37/452 |
| 8,720,874 | B2 * | 5/2014 | Tschida | F16B 19/109 269/229 |
| 9,009,995 | B2 | 4/2015 | Freund et al. | |
| 9,303,674 | B2 * | 4/2016 | Demmeler | F16B 21/165 |
| 9,677,252 | B2 * | 6/2017 | Simpson | E02F 9/2825 |
| 9,951,499 | B2 * | 4/2018 | Simpson | E02F 9/2825 |
| 2006/0037219 | A1 | 2/2006 | Robinson et al. | |
| 2009/0205228 | A1 | 8/2009 | Ruvang | |
| 2010/0162594 | A1 * | 7/2010 | Bierwith | E02F 9/2833 37/450 |
| 2010/0236108 | A1 * | 9/2010 | Ruvang | E02F 9/2825 37/452 |
| 2010/0257759 | A1 | 10/2010 | Ko | |
| 2011/0023336 | A1 | 2/2011 | Briscoe | |
| 2011/0030247 | A1 * | 2/2011 | Ruvang | E02F 9/2825 37/455 |
| 2011/0194912 | A1 * | 8/2011 | Dingwall | E02F 9/2825 411/351 |
| 2012/0102790 | A1 * | 5/2012 | Ruvang | E02F 9/2825 37/455 |
| 2012/0304505 | A1 * | 12/2012 | Ruvang | E02F 9/2825 37/452 |
| 2014/0366409 | A1 * | 12/2014 | Simpson | E02F 9/2825 37/456 |
| 2015/0007464 | A1 * | 1/2015 | Simpson | E02F 9/2825 37/456 |

OTHER PUBLICATIONS

Japanese Office Action dated Feb. 5, 2019 for JP patent application No. 2018-507524, 2 pages.

Translation of Japanese Office Action dated Feb. 5, 2019 for JP patent application No. 2018-507524, 3 pages.

Micro-film of Utility model Application SHO 57-180148 (Utility Model Publication SHO 59-084065), dated Jun. 6, 1984, 10 pages.

Translation of Micro-film of Utility model Application SHO 57-180148 (Utility Model Publication SHO 59-084065), dated Jun. 6, 1984, 10 pages.

* cited by examiner

SECUREMENT OF A WEAR MEMBER TO AN EXCAVATION IMPLEMENT

CROSS-REFERENCE TO RELATED APPLICATION

This application claims the benefit under 35 USC § 119 of the filing date of International Application Serial No. PCT/US16/34332 filed 26 May 2015. The entire disclosure of this prior application is incorporated herein by this reference.

BACKGROUND

This disclosure relates generally to excavation equipment and associated operations and, in an example described below, more particularly provides for securement of a wear member to an excavation implement.

It can be useful to be able to conveniently install and replace wear members on excavation implements. However, the wear members should be secured in a manner that conveniently and securely attaches the wear members to an excavation implement, and provides for reliable detachment from the implement. Therefore, it will be readily appreciated that improvements are continually needed in the art of releasably securing wear members to excavation implements.

DETAILED DESCRIPTION

Figure 1:
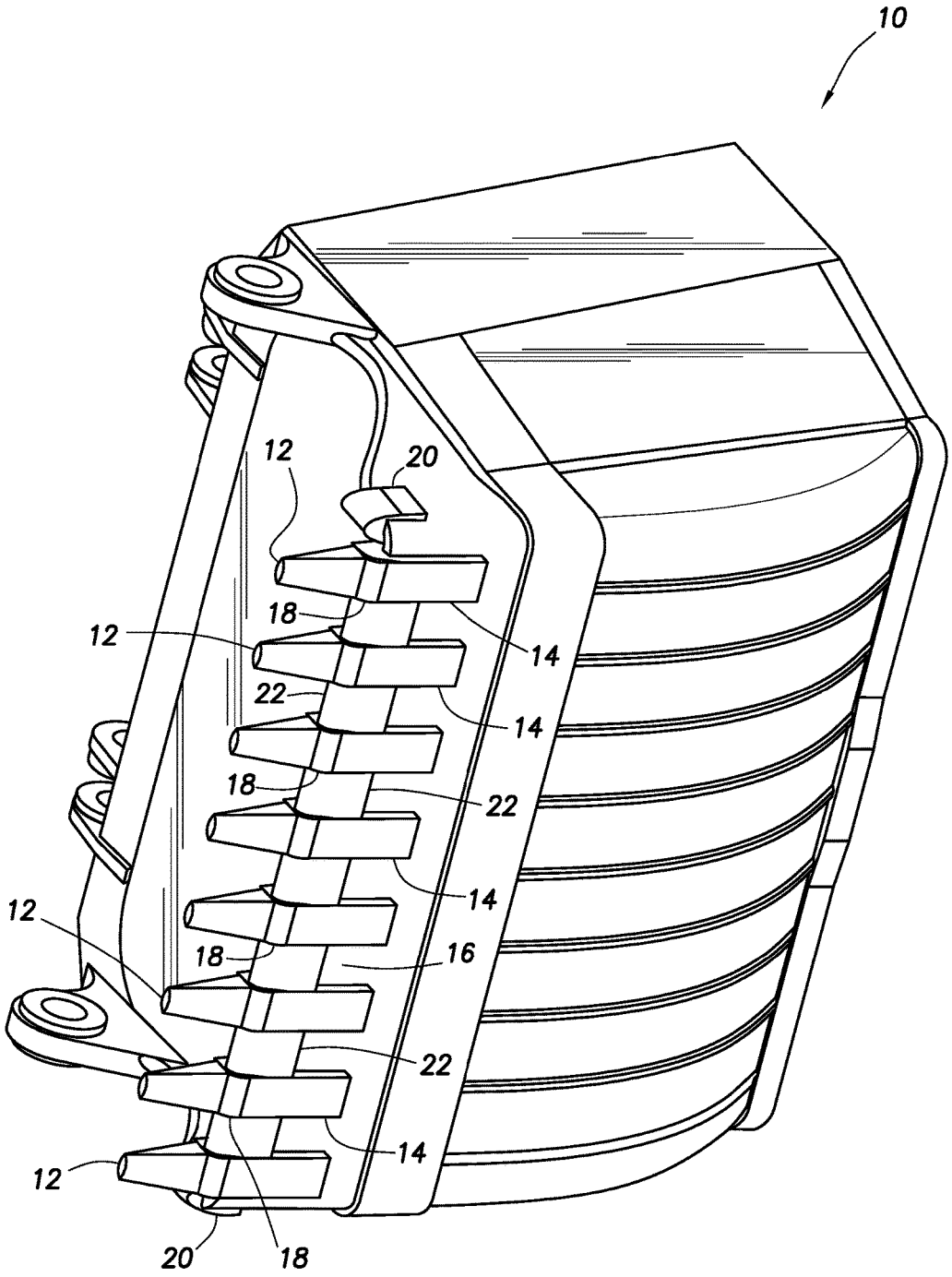
FIG. 1 is a representative perspective view of an example of an excavation implement, and an associated method, which can embody principles of this disclosure.

Representatively illustrated in FIG. 1 is an example of an excavation implement 10 which can embody principles of this disclosure. In the example of FIG. 1, the implement 10 is of the type known as a "dipper" or "bucket" of a cable shovel, but it should be clearly understood that the principles of this disclosure can be utilized with other types of excavation implements.

In the illustration of FIG. 1, the implement 10 is rotated so that an earth-engaging side of the implement is clearly visible. From this perspective, it may be seen that multiple teeth 12 are mounted on the implement 10 for piercing the earth.

These teeth 12 are typically eventually worn down or otherwise damaged during use of the implement 10, and so replacement of the teeth should be conveniently, economically, rapidly and safely accomplished. These objectives are obtained, according to the principles of this disclosure, by use of specially configured connectors (not visible in FIG. 1, described more fully below) that releasably secure the teeth 12 to tooth adapters 18 which are, in turn, releasably secured to mounting adapters 14 secured to a forward lip 16 of the implement 10. In this manner, the teeth 12 are releasably secured to the implement 10.

Although, in the FIG. 1 example, multiple adapters 14, 18 are used to mount each of the teeth 12, in other examples only a single adapter may be used to mount each tooth, or the teeth could be mounted without use of any adapters. Thus, the scope of this disclosure is not limited to use of any particular number of adapters, or to use of any adapters at all.

The teeth 12 and tooth adapters 18 are merely examples of wear members that can be securely and conveniently attached to an excavation implement using the principles of this disclosure. Other examples of wear members include shrouds 20, 22. Thus, the scope of this disclosure is not limited to use of any particular types or combinations of wear members.

The mounting adapters 14 and tooth adapters 18 are merely examples of mounting structures to which a wear member can be releasably secured using the principles of this disclosure. Other types of mounting structures may be used in other examples. Thus, the scope of this disclosure is not limited to releasably securing a wear member to any particular type of mounting structure.

Figure 2:
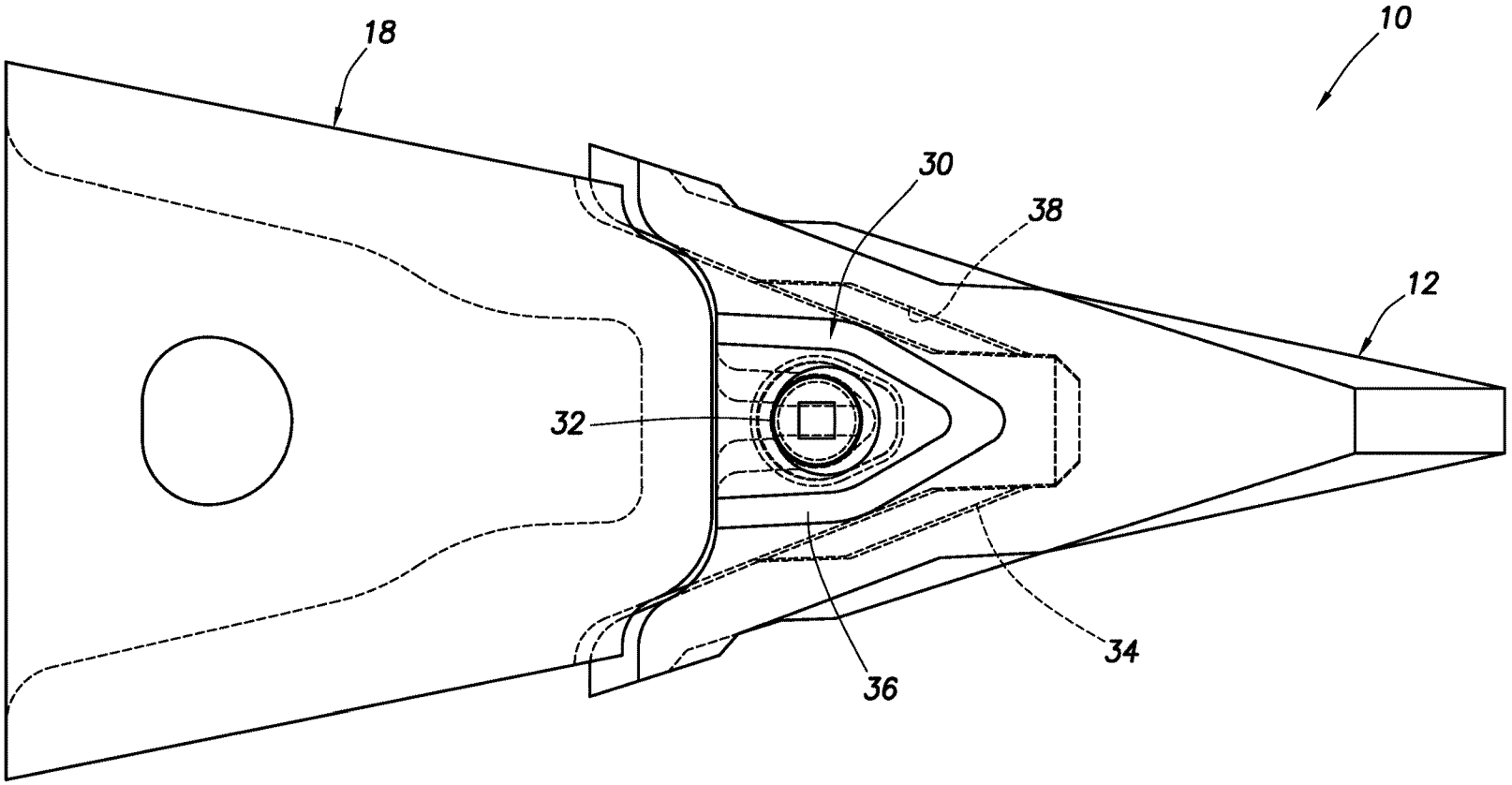
FIG. 2 is a representative side view of a tooth and adapter for securement to the excavation implement.

Referring additionally now to FIG. 2, an example of a wear member attachment system 30 for releasably securing a tooth 12 to an adapter 18 is representatively illustrated, for use with the excavation implement 10. However, it is not necessary for the wear member attachment system 30 to be used with the tooth 12, the adapter 18 or the excavation implement 10, in keeping with the principles of this disclosure. In other examples, the wear member attachment system 30 could be used to releasably secure the adapter 18 to the adapter 14, or to secure another wear member to another mounting structure.

In the FIG. 2 example, the system 30 includes a connector 32 received in a nose 34 of the adapter 18 and engaged with opposing side walls 36 of the tooth 12. The nose 34 is received in a recess or pocket 38 formed in the tooth 12.

Figure 3:
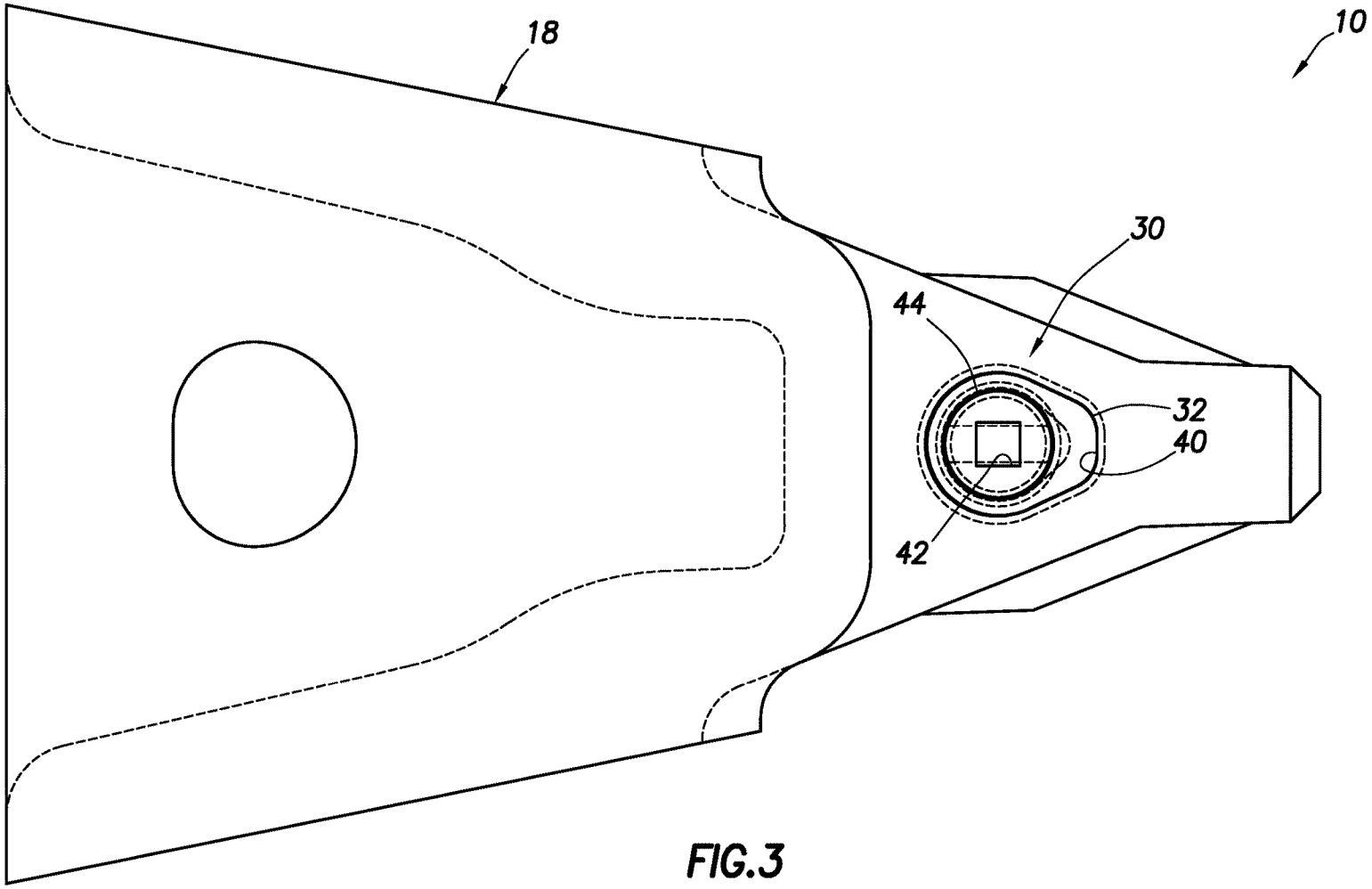
FIGS. 3 & 4 are representative side and top views of the adapter with a connector installed therein.

Referring additionally now to FIG. 3, the adapter 18 and connector 32 are depicted, with the tooth 12 removed from the adapter and not shown. The connector 32 is received in an opening 40 formed through the nose 34 of the adapter 18.

As described more fully below, the connector 32 can be configured to permit removal and installation of the tooth 12 and, when the tooth is installed on the adapter 18, to prevent removal of the tooth from the adapter. In this example, a square socket 42 is provided in an engagement device 44 of the connector 32 for convenience in rotating the engagement device between locked and unlocked positions. In the unlocked position, the tooth 12 can be removed from, or installed on, the adapter 18. In the locked position, the tooth 12 is secured against removal from the adapter 18.

Note that the connector 32 and the opening 40 are non-circular. This prevents rotation of the connector 32 relative to the opening 40 when the engagement device 44 is rotated between its locked and unlocked positions.

Figure 4:
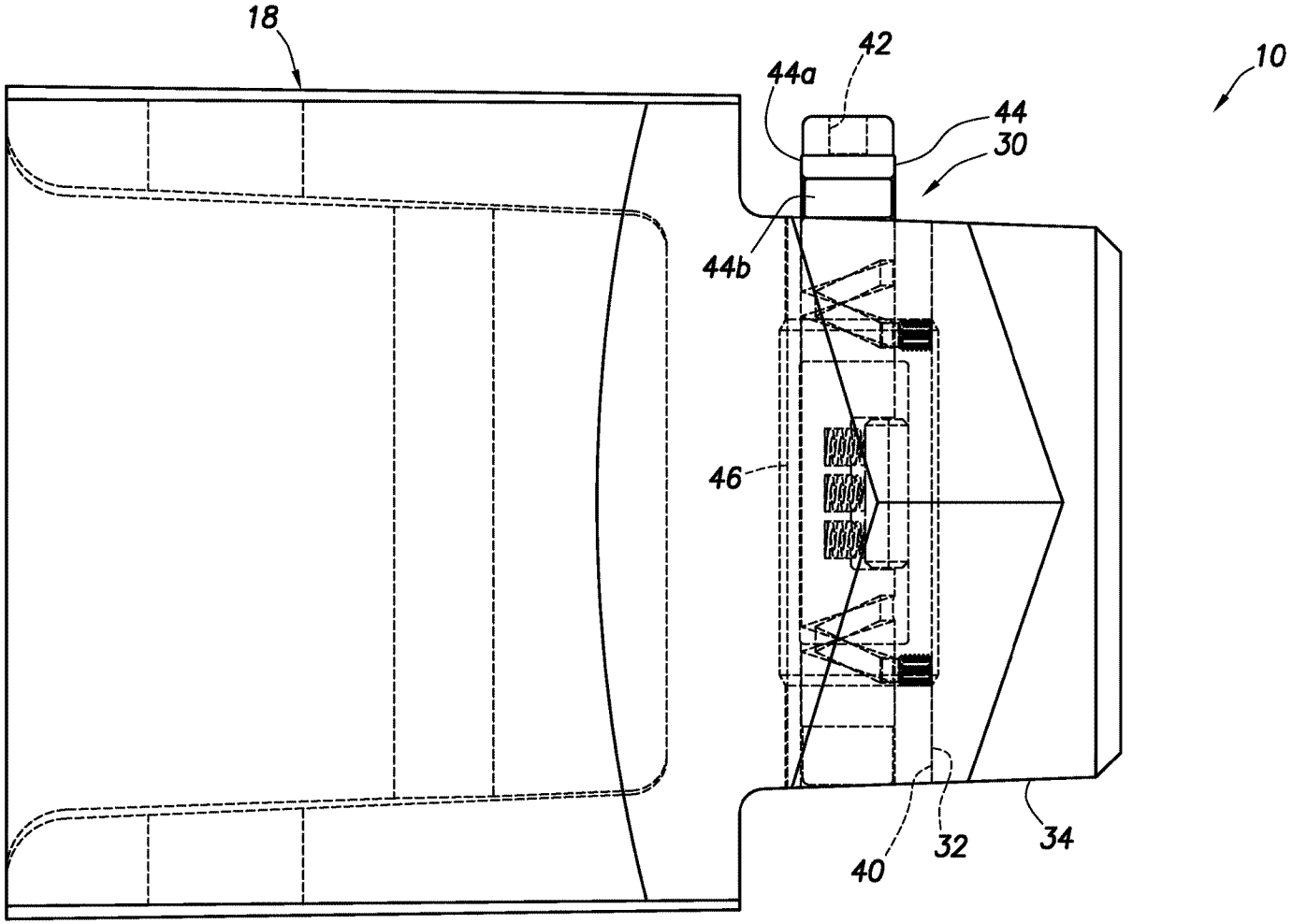

Referring additionally now to FIG. 4, an elevational view of the connector 32 in the adapter 18 is representatively illustrated. Note that the connector 32 is reversed in the opening 40, as compared to its orientation in the FIG. 3 example.

As depicted in FIG. 4, the engagement device 44 is in its unlocked position. An engagement member 44*a* of the device 44 is extended outwardly from a housing 46 of the connector 32 received in the opening 40.

Slots 44*b*, formed laterally across the engagement member 44*a*, are external to the housing 46, and are oriented so that the tooth 12 can be installed on, or removed from, the adapter 18. Only one of the slots 44*b* is visible in FIG. 4. Two oppositely facing slots 44*b* are visible in FIGS. 7 & 9.

Figure 5:
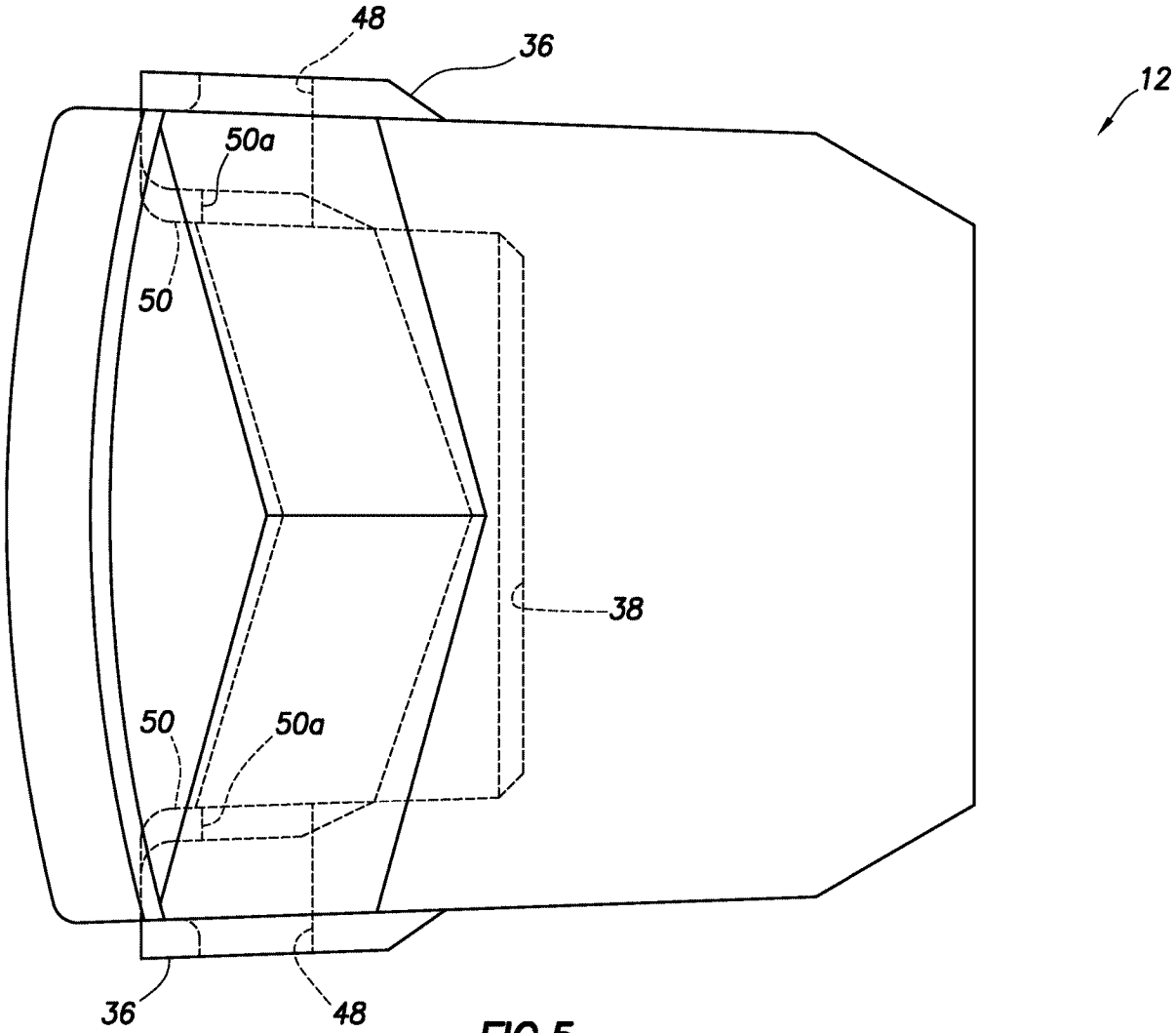
FIGS. 5 & 6 are representative top and side views of the tooth.
Figure 6:
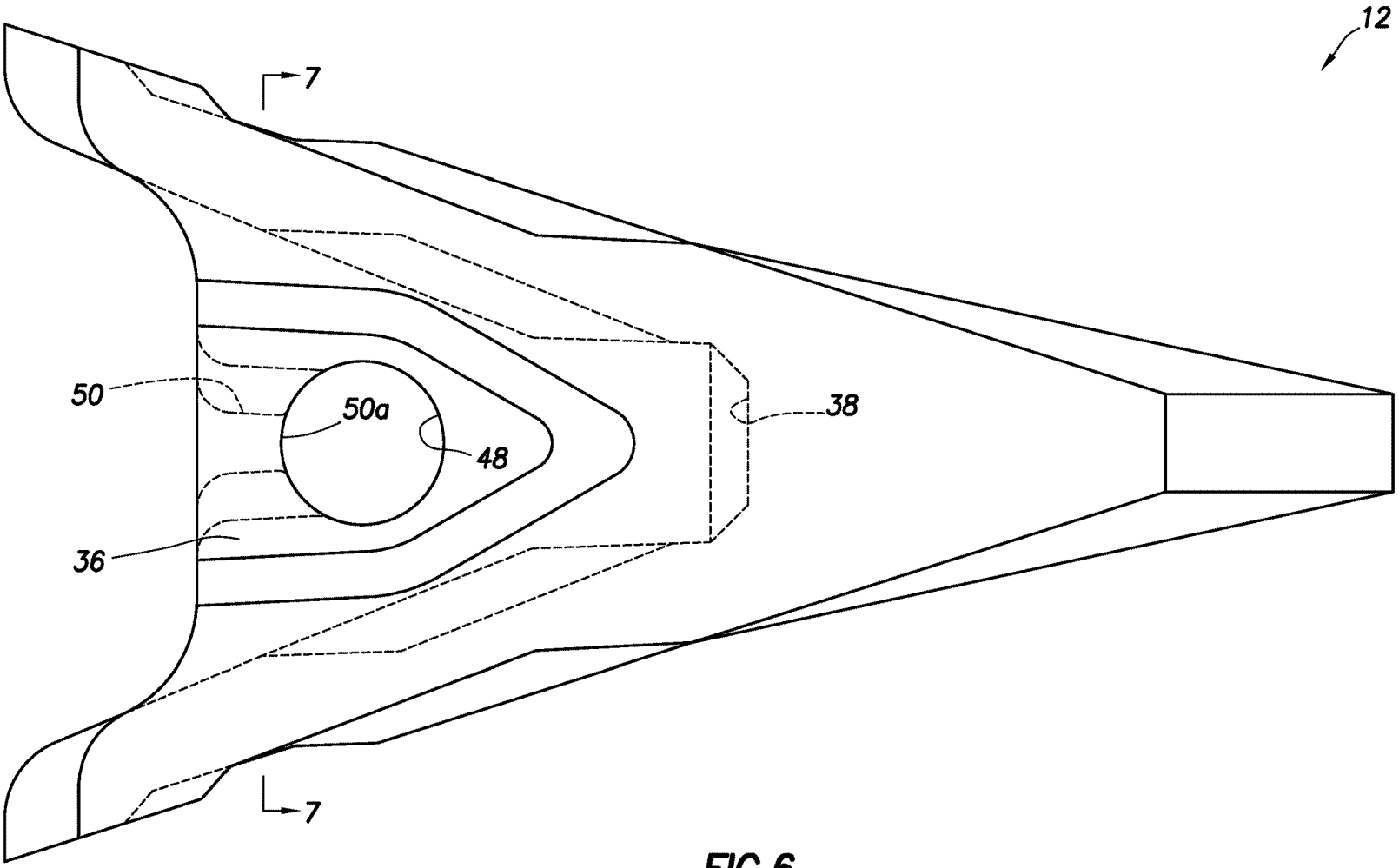

Referring additionally now to FIGS. 5 & 6, elevational and side views of the tooth 12 are representatively illustrated. In these views, it may be seen that openings 48 are formed through the side walls 36 of the tooth 12 for convenient access to the engagement device 44 of the connector 32. This access enables the engagement device 44 to be rotated to its locked and unlocked positions while the tooth 12 is installed on the adapter 18.

Note that projections 50 are formed in the tooth 12 at an entrance to the pocket 38. The projections 50 extend from the pocket 38 entrance to the openings 48. Thus, ends 50*a* of the projections 50 terminate at the openings 48 in this example.

Figure 7:
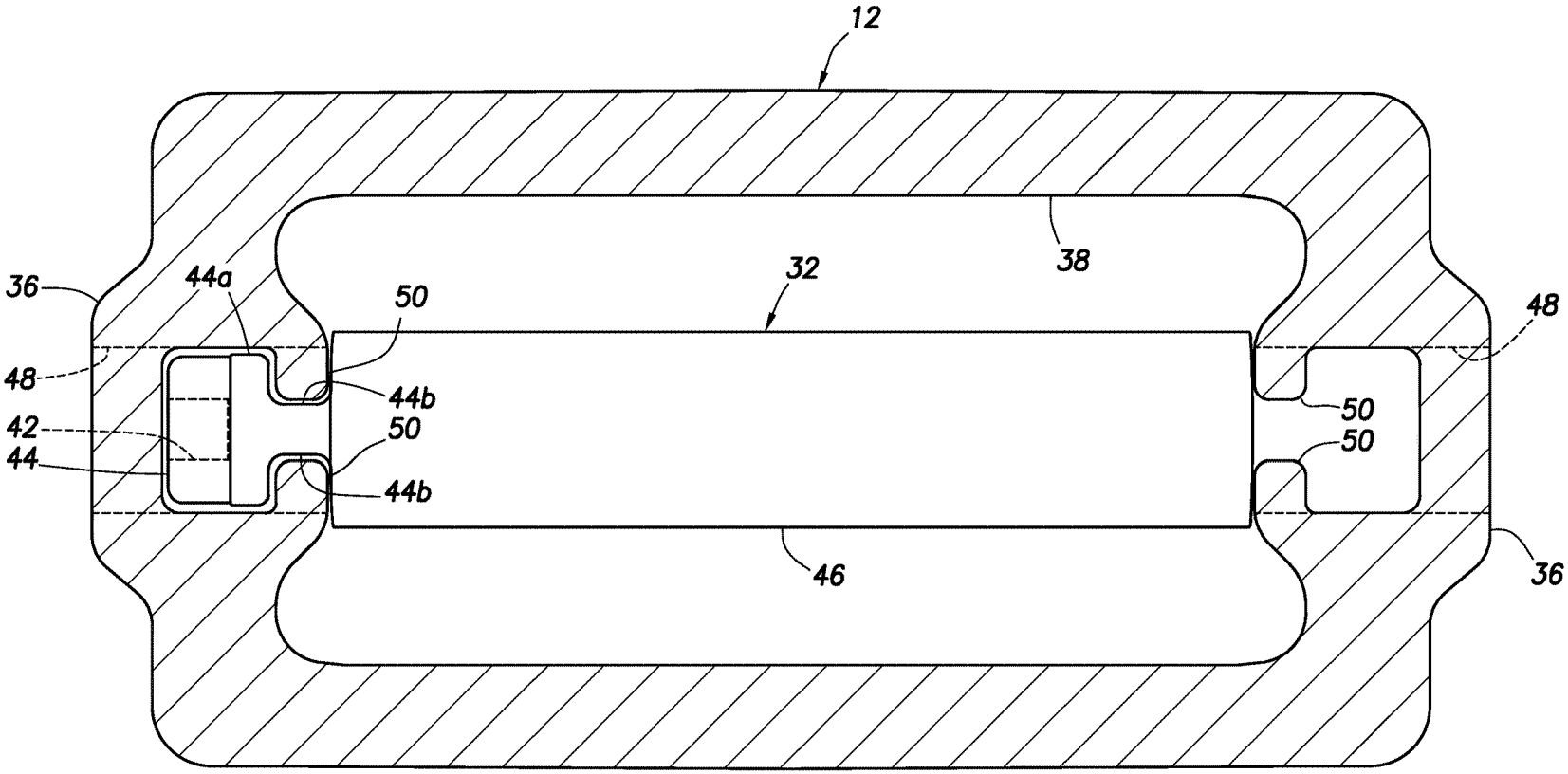
FIGS. 7 & 8 are representative cross-sectional views of the tooth, taken along line 7-7 of FIG. 6, with the connector in respective unlocked and locked configurations.

Referring additionally now to FIG. 7, a cross-sectional view of the tooth 12 is representatively illustrated, with the connector 32 therein. The connector 32 is positioned as it would be received in the opening 40 of the adapter 18, although the adapter is not depicted in FIG. 7.

As shown in FIG. 7, the engagement device 44 is in its unlocked position. The engagement member 44*a* is extended outward from the housing 46 of the connector 32. The slots 44*b* in the engagement member 44*a* are aligned with the projections 50 in the tooth 12. Thus, the tooth 12 can be displaced relative to the connector 32 when the engagement device 44 is in its unlocked position.

Figure 8:
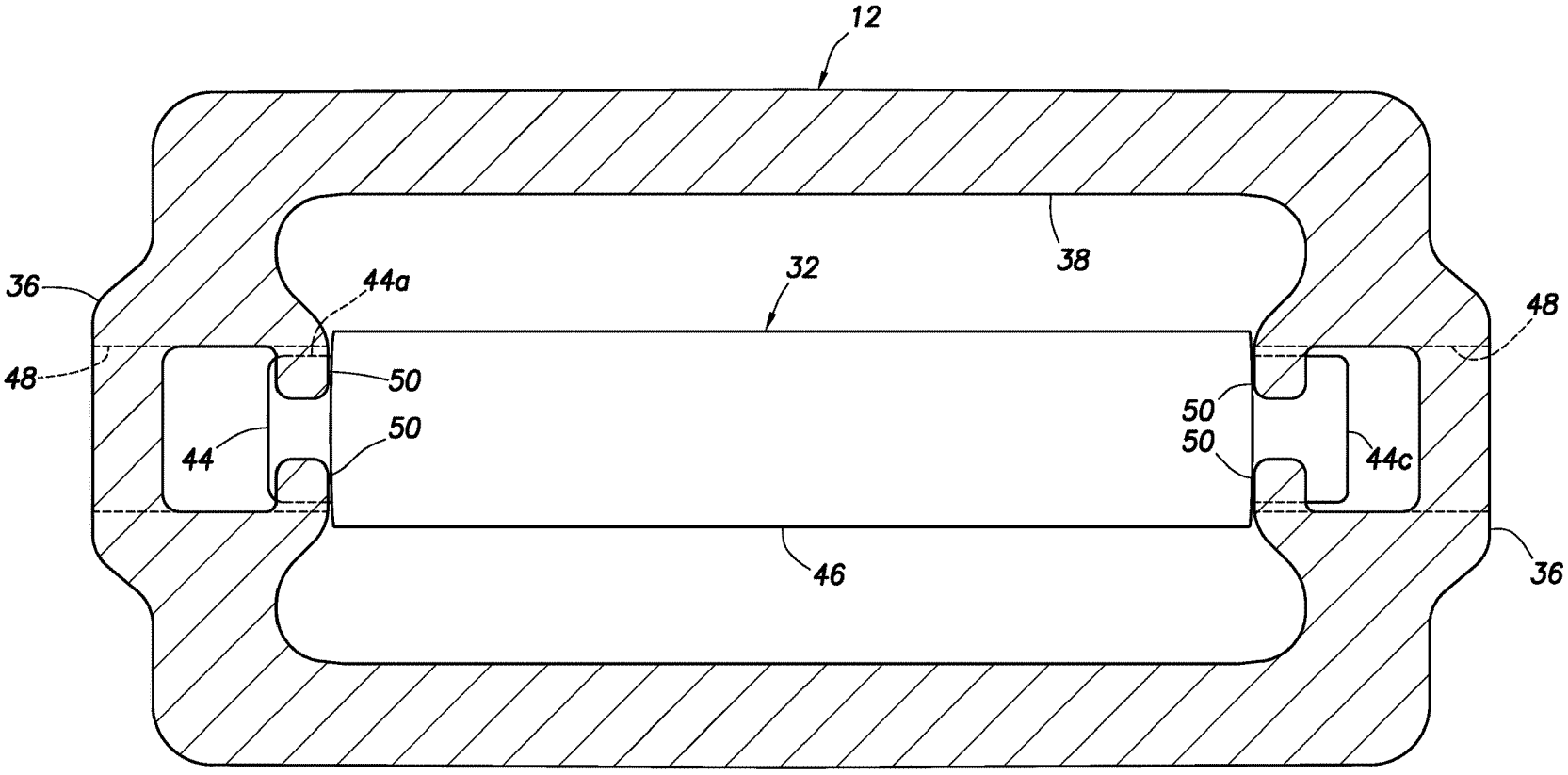

Referring additionally now to FIG. 8, another cross-sectional view of the tooth 12 is representatively illustrated, with the connector 32 therein. In this view, the engagement member 44 is rotated to its locked position.

The engagement member 44*a* is now retracted toward the housing 46 of the connector 32. The slots 44*b* are received in the housing 46 and are not aligned with the projections 50 in the tooth 12. In addition, another connector member 44*c* now extends outwardly from the housing 46.

In this locked position of the engagement device 44, relative displacement between the tooth 12 and connector 32 is restricted. If the connector 32 were received in the adapter 18, the nose 34 of the adapter received in the pocket 38 of the tooth 12, and the engagement device 44 in the locked position of FIG. 8, removal of the tooth from the adapter would be prevented. Thus, in the locked position of the engagement device 44, the engagement members 44*a,c* will engage the ends 50*a* (see FIGS. 5 & 6) of the projections 50, and will thereby prevent removal of the tooth 12 from the adapter 18.

Figure 9:
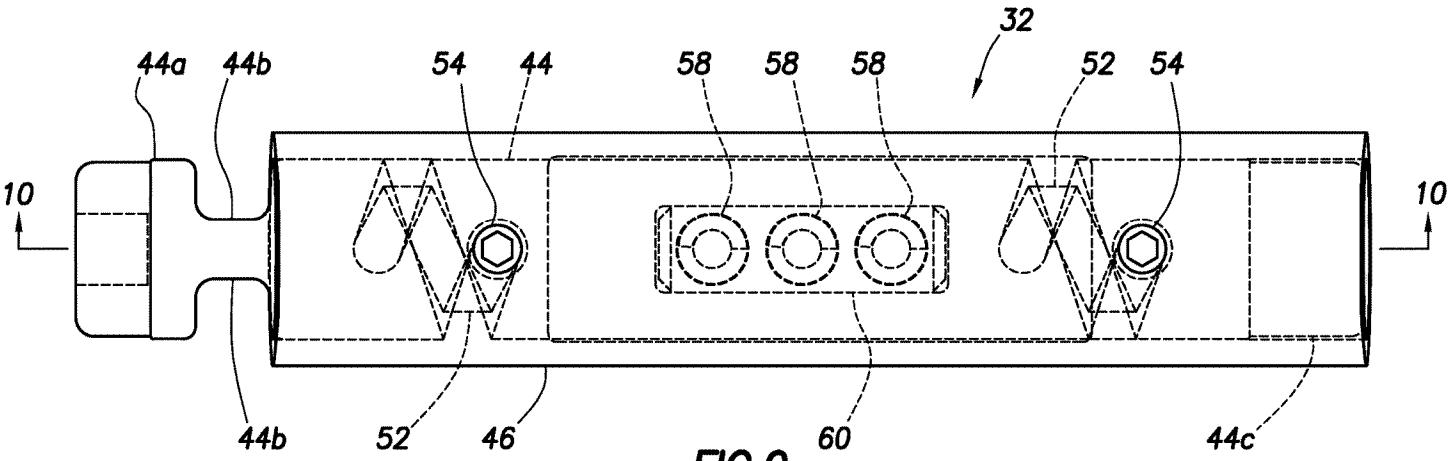
FIG. 9 is a representative side view of the connector.
Figure 10:
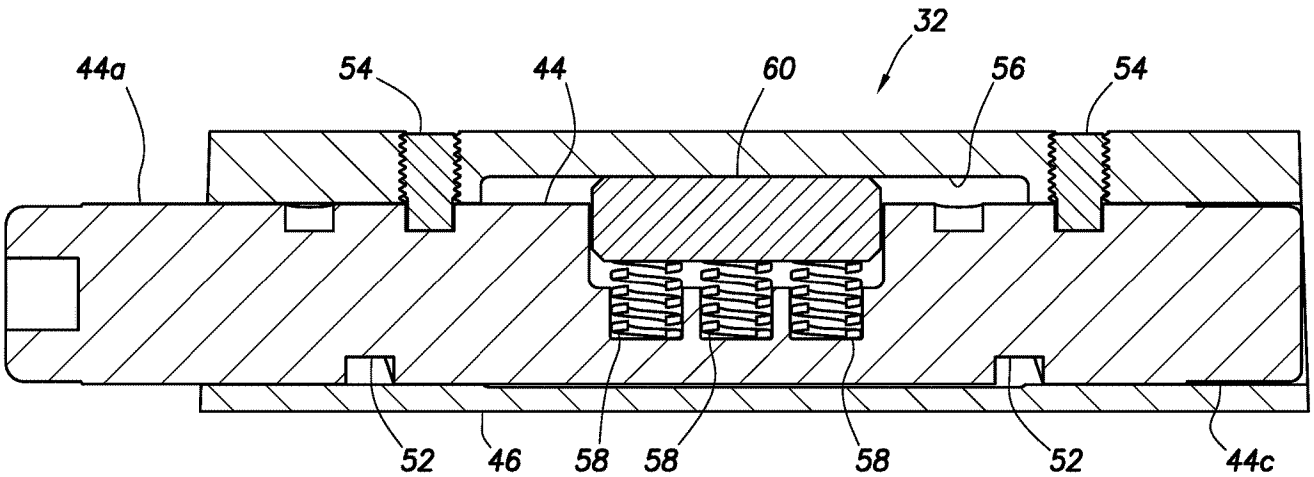
FIGS. 10 & 11 are representative cross-sectional views of the connector, taken along line 10-10 of FIG. 9, with the connector in respective unlocked and locked configurations.
Figure 11:
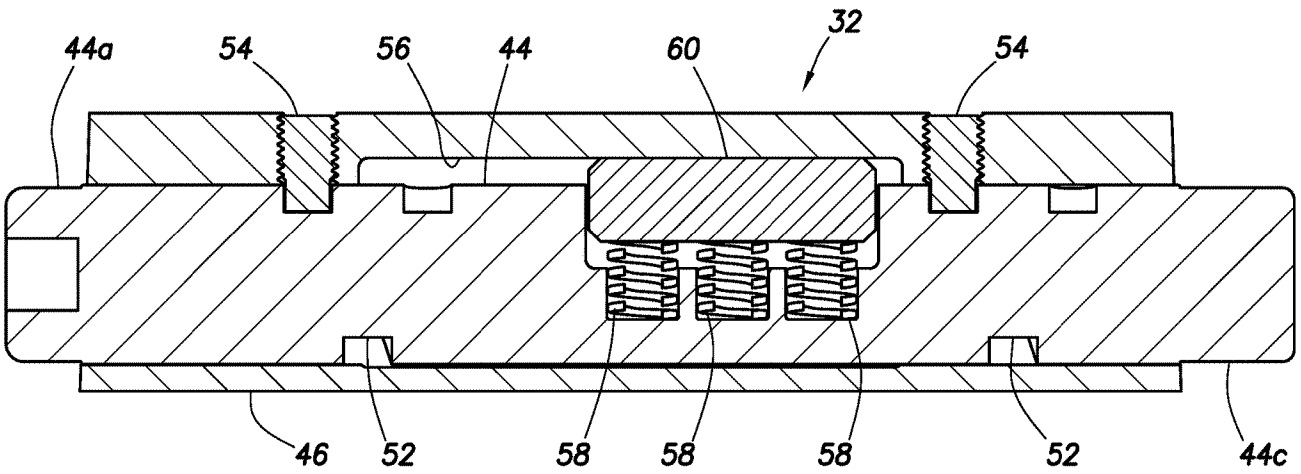

Referring additionally now to FIGS. 9-11, the connector 32 is representatively illustrated apart from the tooth 12 and adapter 18. The engagement device 44 is in the unlocked position as depicted in FIGS. 9 & 10, and the engagement device is in the locked position as depicted in FIG. 11.

In this example, the engagement device 44 is a single element, with the engagement members 44*a,c* being formed at opposite ends of the engagement device. In other examples, the engagement members 44*a,c* could be separate elements fastened (or otherwise connected) together, so that the members are rotatable together.

Similarly, the housing 46 is depicted as being a single element, but in other examples the housing could be made up of multiple elements. Thus, the scope of this disclosure is not limited to any particular configuration of the connector 32.

In the FIGS. 9-11 example, two cam profiles 52 are formed as helical recesses or grooves on the engagement device 44. Respective pins or cam followers 54 extend through the housing 46 and into engagement with the cam profiles 52.

When the engagement device 44 is rotated, the engagement between the cam profiles 52 and the followers 54 induces longitudinal displacement of the engagement device relative to the housing 46. In this example, the cam profiles 52 are configured so that 360 degrees of rotation of the engagement device 44 will cause the engagement device to displace longitudinally from its unlocked position to its locked position, or vice versa.

In other examples, the cam profiles 52 and followers 54 could be replaced by threads or another device or mechanism (such as a J-slot or ratchet mechanism) capable of inducing longitudinal displacement of the engagement device 44. It is also not necessary for multiple cam profiles 52 and followers 54 to be provided.

A longitudinally extending recess 56 is formed in the housing 46. One or more biasing devices 58 (such as, coiled springs, leaf springs, elastomeric or other resilient members, etc.) exert an outwardly directed biasing force against a detent member 60.

When the engagement device 44 is in the locked or unlocked position, the biasing devices 58 bias the detent member 60 into engagement with the recess 56. This engagement resists rotation of the engagement device 44 away from the locked or unlocked position. In order for the engagement device 44 to be rotated away from the locked or unlocked position, the biasing devices 58 are compressed to enable the detent member 60 to disengage from the recess 56.

Although the biasing devices 58 and detent member 60 are separate elements in the FIGS. 9-11 example, in other examples they could be a single member. For example, a resilient collet could serve as both a biasing device and a detent member.

Figure 12:
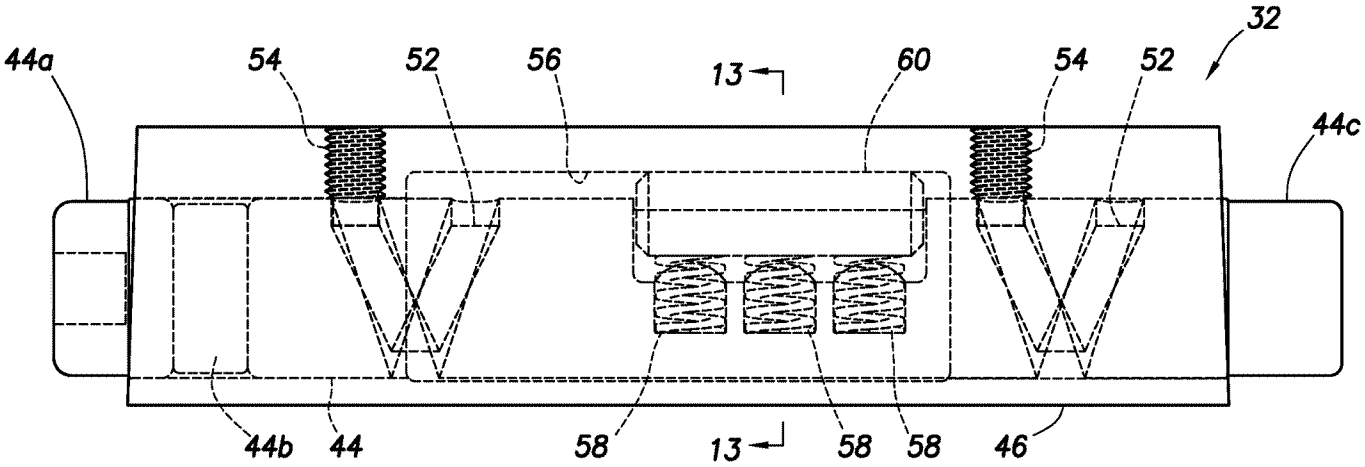
FIG. 12 is a representative top view of the connector.
Figure 14:
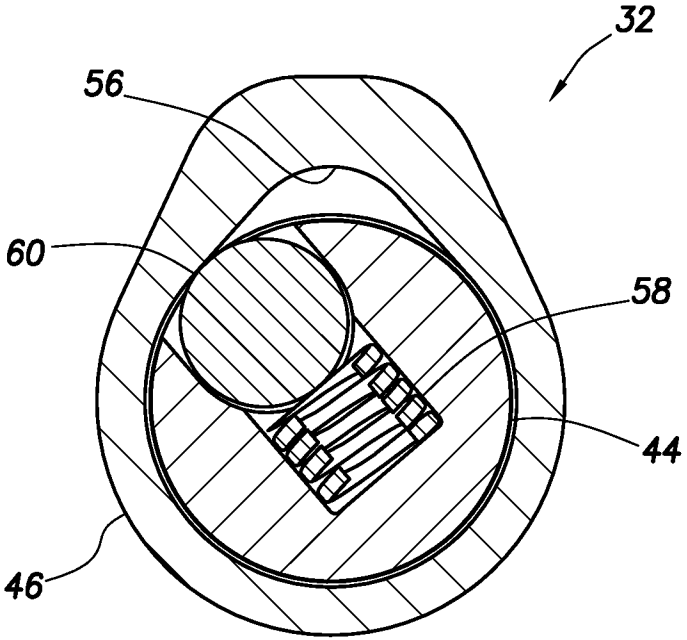
FIGS. 13 & 14 are representative cross-sectional views of the connector, taken along line 13-13 of FIG. 12, with an engagement device of the connector in different rotational orientations.
Figure 13:
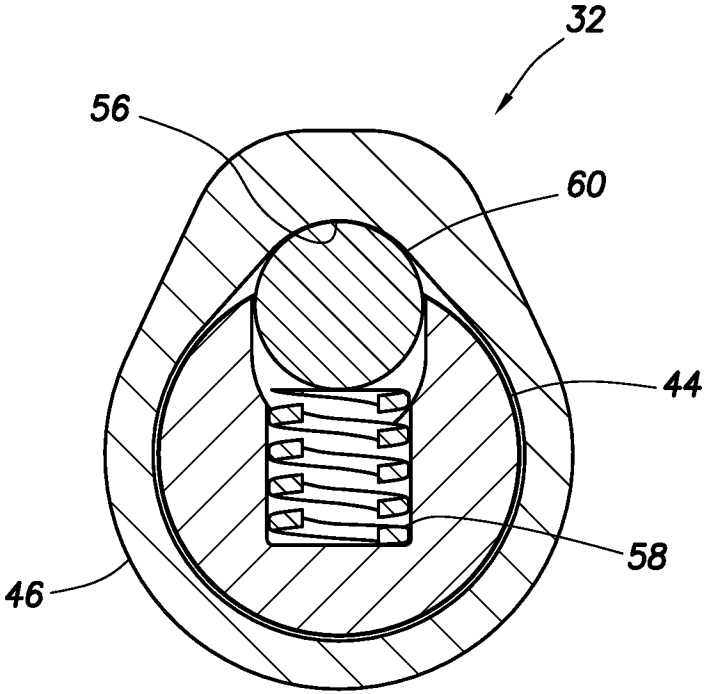

Referring additionally now to FIGS. 12-14, the connector 32 is representatively illustrated in various configurations. In FIGS. 12 & 13, the engagement device 44 is in its locked position, with the detent member 60 fully engaged in the recess 56. In FIG. 14, the engagement device 44 has been rotated somewhat away from the locked or unlocked position.

Note that, in order to rotate the engagement device 44 away from the locked or unlocked position, the detent member 60 is displaced inward, so that the biasing devices 58 are compressed. This increases the biasing force exerted by the biasing devices 58, and so such rotation away from the locked or unlocked position is resisted.

It may now be fully appreciated that the above disclosure provides significant advancements to the art of securing a wear member (such as, the tooth 12, the adapter 18, etc.) to an excavation implement. In examples described above, the connector 32 conveniently and reliably provides for releasable attachment of a wear member to a mounting structure of an excavation implement.

A wear member attachment system 30 is provided to the art for use with an excavation implement 10 by the above disclosure. In one example, the system 30 comprises a connector 32 that releasably secures a wear member 12 to the excavation implement 10. The connector 32 includes: a) an elongated housing 46, b) a first engagement member 44*a* extendable and retractable relative to the housing 46, and c) a second engagement member 44*c* extendable and retractable relative to the housing 46. The first engagement member 44*a* extends relative to the housing 46 when the second engagement member 44*c* retracts relative to the housing 46. The first engagement member 44*a* retracts relative to the housing 46 when the second engagement member 44*c* extends relative to the housing 46.

The first and second engagement members 44*a,c* may displace simultaneously relative to the housing 46. The first and second engagement members 44*a,c* may displace longitudinally relative to the housing 46 in response to rotation of the first and second engagement members 44*a,c* relative to the housing 46.

The connector 32 may include a cam profile 52 that induces longitudinal displacement of the first and second engagement members 44*a,c* in response to rotation of the first and second engagement members 44*a,c*.

The system 30 may include at least one biasing device 58 that resists rotation of the first and second engagement members 44*a,c* away from a predetermined rotational position relative to the housing 46. The biasing device 58 may be compressed in response to the rotation of the first and second engagement members 44*a,c* away from the predetermined rotational position. The biasing device 58 may bias a detent member 60 toward a recess 56 formed in the housing 46.

The first engagement member 44*a* may have oppositely facing slots 44*b* laterally disposed relative to the housing 46. The slots 44*b* may be retracted into the housing 46 when the second engagement member 44*c* is extended. The slots 44*b* may be configured to align with projections 50 in the wear member 12. A portion of the first engagement member 44*a* may engage ends 50*a* of the projections 50 and thereby prevent removal of the wear member 12 from the excavation implement 10 in response to retraction of the first engagement member 44*a*.

The first engagement member 44*a* may be in an extended position relative to the housing 46 when the second engagement member 44*c* is in a retracted position relative to the housing 46. The first engagement member 44*a* may be in a retracted position relative to the housing 46 when the second engagement member 44*c* is in an extended position relative to the housing 46.

A method of releasably securing a wear member (such as, the tooth 12, the adapter 18, etc.) to an excavation implement 10 is also provided to the art by the above disclosure. In one example, the method comprises rotating a first engagement member 44*a* of a connector 32 from an extended position in which opposing slots 44*b* in the first engagement member 44*a* are aligned with respective projections 50 in the wear member 12, to a retracted position in which the slots 44*b* are not aligned with the projections 50. The rotating step includes extending a second engagement member 44*c* of the connector 32 as the first connector 44*a* displaces from the extended position to the retracted position.

The rotating step can include the first and second engagement members 44*a,c* displacing longitudinally relative to a housing 46 of the connector 32.

The displacing step can include a cam profile 52 inducing longitudinal displacement of the first and second engagement members 44*a,c* in response to the rotating step.

The method can include at least one biasing device 58 resisting rotation of the first and second engagement members 44*a,c* away from a predetermined rotational position relative to a housing 46 of the connector 32. The resisting step can include compressing the biasing device 58 in response to the rotation of the first and second engagement members 44*a,c* away from the predetermined rotational position. The resisting step can include the biasing device 58 biasing a detent member 60 toward a recess 56 formed in the housing 46.

The rotating step can include retracting the slots 44*b* into a housing 46 of the connector 32.

The method can include, in response to the rotating step, a portion of the first engagement member 44*a* engaging ends 50*a* of the projections 50 and thereby preventing removal of the wear member 12 from the excavation implement 10.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A wear member attachment system for use with an excavation implement, the system comprising:

a wear member, a connector that releasably secures the wear member to the excavation implement, the connector including: a) an elongated housing, b) a first engagement member extendable and retractable relative to the housing, and c) a second engagement member extendable and retractable relative to the housing, wherein the connector is configured to be installed in the excavation implement prior to placement of the wear member on the excavation implement, wherein the first and second engagement members are configured to concurrently engage opposing walls of the wear member, wherein the first engagement member extends relative to the housing when the second engagement member retracts relative to the housing, and wherein the first engagement member retracts relative to the housing when the second engagement member extends relative to the housing.

2. The system of claim 1, wherein the first and second engagement members displace simultaneously relative to the housing.

3. The system of claim 1, wherein the first and second engagement members displace longitudinally relative to the housing in response to rotation of the first and second engagement members relative to the housing.

4. The system of claim 3, wherein the connector further includes a cam profile that induces longitudinal displacement of the first and second engagement members in response to the rotation of the first and second engagement members.

5. The system of claim 1, further comprising at least one biasing device that resists rotation of the first and second engagement members away from a predetermined rotational position relative to the housing.

6. The system of claim 5, wherein the biasing device is compressed in response to the rotation of the first and second engagement members away from the predetermined rotational position.

7. The system of claim 5, wherein the biasing device biases a detent member toward a recess formed in the housing.

8. The system of claim 1, wherein the first engagement member comprises oppositely facing slots laterally disposed relative to the housing.

9. The system of claim 8, wherein the slots are retracted into the housing when the second engagement member is extended.

10. The system of claim 8, wherein the slots are configured to align with projections in the wear member.

11. The system of claim 1, wherein the first engagement member is in an extended position relative to the housing when the second engagement member is in a retracted position relative to the housing, and wherein the first engagement member is in a retracted position relative to the housing when the second engagement member is in an extended position relative to the housing.

12. A wear member attachment system for use with an excavation implement, the system comprising:

a connector that releasably secures a wear member to the excavation implement, the connector including: a) an elongated housing, b) a first engagement member extendable and retractable relative to the housing, and c) a second engagement member extendable and retractable relative to the housing, wherein the first and second engagement members are configured to concurrently engage opposing walls of the wear member, wherein the first engagement member extends relative to the housing when the second engagement member retracts relative to the housing, wherein the first engagement member retracts relative to the housing when the second engagement member extends relative to the housing, wherein the first engagement member comprises oppositely facing slots laterally disposed relative to the housing, wherein the slots are configured to align with projections in the wear member, and wherein a portion of the first engagement member engages ends of the projections and thereby prevents removal of the wear member from the excavation implement in response to retraction of the first engagement member.

13. A method of releasably securing a wear member to an excavation implement, the method comprising:

rotating a first engagement member of a connector from an extended position in which opposing slots in the first engagement member are aligned with respective projections in the wear member, to a retracted position in which the slots are not aligned with the projections, and wherein the rotating comprises extending a second engagement member of the connector as the first engagement member displaces from the extended position to the retracted position.

14. The method of claim 13, wherein the rotating further comprises the first and second engagement members displacing longitudinally relative to a housing of the connector.

15. The method of claim 14, wherein the displacing comprises a cam profile inducing longitudinal displacement of the first and second engagement members in response to the rotating.

16. The method of claim 13, further comprising at least one biasing device resisting rotation of the first and second engagement members away from a predetermined rotational position relative to a housing of the connector.

17. The method of claim 16, wherein the resisting comprises compressing the biasing device in response to the rotation of the first and second engagement members away from the predetermined rotational position.

18. The method of claim 16, wherein the resisting comprises the biasing device biasing a detent member toward a recess formed in the housing.

19. The method of claim 13, wherein the rotating further comprises retracting the slots into a housing of the connector.

20. The method of claim 13, further comprising, in response to the rotating, a portion of the first engagement member engaging ends of the projections and thereby preventing removal of the wear member from the excavation implement.

* * * * *